United States Patent [19]

Ejlersen

[11] Patent Number: 4,923,375

[45] Date of Patent: May 8, 1990

[54] HOSE PUMP, IN PARTICULAR AN INSULIN PUMP

[76] Inventor: Henning M. Ejlersen, Trorod Kollegiet 15A, DK-2950 Vedbæk, Denmark

[21] Appl. No.: 318,452

[22] Filed: Mar. 1, 1989

Related U.S. Application Data

[63] Continuation of Ser. No. 20,944, filed as PCT DK86/00054 on May 15, 1986, published as WO86/06796 on Nov. 20, 1986, abandoned.

[30] Foreign Application Priority Data

May 15, 1985 [DK] Denmark ..... 2160/85

[51] Int. Cl.[5] ..... F04B 43/12

[52] U.S. Cl. ..... 417/477; 417/476

[58] Field of Search ..... 417/474, 475, 476, 477; 128/DIG. 12; 604/153

[56] References Cited

U.S. PATENT DOCUMENTS

| | | | |
|---|---|---|---|
| 819,690 | 5/1906 | Bryson . | |
| 922,205 | 5/1909 | Still | 417/477 X |
| 2,917,002 | 12/1959 | Mascaro | 417/477 |
| 2,925,045 | 2/1960 | Mascaro | 417/477 |
| 3,724,974 | 4/1973 | Molimard | 417/477 |
| 3,787,148 | 1/1974 | Lopf | 417/477 |
| 4,397,617 | 8/1983 | Sergio et al. | 417/475 |
| 4,492,538 | 1/1985 | Iwata | 417/477 |
| 4,573,887 | 3/1986 | Smith | 417/477 |

FOREIGN PATENT DOCUMENTS 0026704 4/1981 European Pat. Off. .

OTHER PUBLICATIONS

EP Al, 0 026 704 and a Search Report EP 80 40 1357 Contained Therein.

*Primary Examiner*—Donald E. Stout
*Assistant Examiner*—Eugene L. Szczecina, Jr.
*Attorney, Agent, or Firm*—Ladas & Parry

[57] ABSTRACT

A hose pump (1) consisting of a hose (2), at least one, preferably two pressure rollers (3,4), a support plate (9) and a drive source (26). The hose (2) is paced in a hose receiving track (6) in the support plate (9). The rollers (3,4) are rotatably journalled on a common rotary shaft (10), whose center (11) is firmly connected with a drive shaft (12), which is perpendicular to the support face (5) of the support plate (9) engaging the rollers (3,4). The rollers (3,4) act on the hose (2) in the flow direction of the pump (1) and alternately determine, in specific angle ranges, the liquid volume flow discharged. The succeeding roller (4) cooperates with the hose (2) in such a manner that the hose is completely closed when the forwardly disposed roller (3), as seen in the flow direction, initiates its disengaging movement away from the hose (2). During the following opening movement of the forwardly disposed roller (3) from having closed the hose (2) completely to letting it be completely open, the succeeding roller (4) cooperates with the hose (2) so that hose, in addition to discharging a volume flow corresponding to the normal volume flow of the pump (1), also discharges an additional volume flow to compensate for the loss caused by the opening movement of the forwardly disposed roller (3). Then, the volume flow discharged by the pump (1) is constant per unit of time. Further, reverse suction in the outlet end of the hose is obviated.

14 Claims, 3 Drawing Sheets

HOSE PUMP, IN PARTICULAR AN INSULIN PUMP

Figure 1:
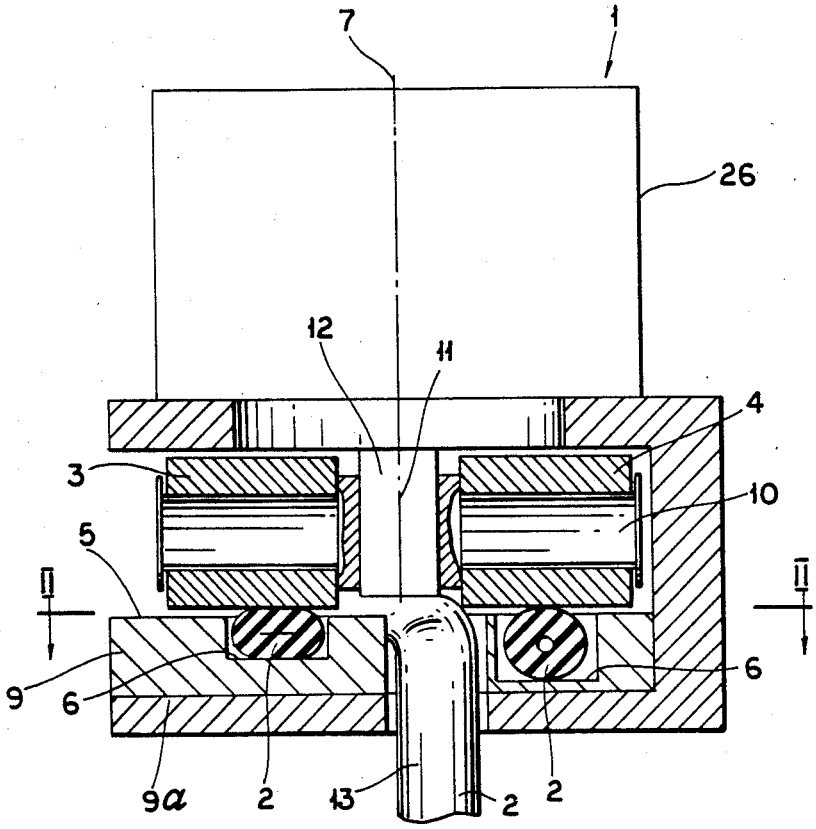

This is a continuation of co-pending application Ser. No. 020,944 filed on FEB. 3, 1987 now abandoned and PCT/DK86/00054 filed on MAY 15, 1986.

The invention concerns a hose pump of the type having an elastic hose which may be compressed locally between a hose supporting face and at least one rotatable pressure roller, the supporting face forming a track to receive the hose and with a varying depth which determines the degree of hose compression.

Pumps of the above type are known, in which it has been attempted achieve with a constant speed of pressure-roller rotation and varying hose track depth a constant volume supply per angular unit of pressure-roller rotation. Thus, e.g. the German Patent publication 29 21 066 discloses a structure where the spacing of the inlet and outlet paths from the pressure rollers is modified so that the length of the hose extension is extended. However, experience with this hose pump type has shown that the volume supplied by the pump nevertheless varies greatly with an extended outlet path. The U.S. patent specification No. 3 758 239 likewise describes a hose pump in which the outlet path has been extended by incorporation of a compensating element, where the hose is overcompressed, as is also the case e.g. in the art taught by the EP Patent Publication 26 704. Nor do these pumps supply a reliable and constant volume in a simple manner, and these pumps have moreover a relatively complicated structure, with many components. Other hose pumps of this type are known, but it is common to all of them that a constant volume is not delivered with certainty, which may result in reverse suction in the outlet path when the rollers relieve the hose.

The object of the invention is to provide a hose pump of the type stated above which delivers a constant volume for a given angular rotation of the pump drive shaft, and in which the problem of reverse suction is simultaneously eliminated. Another object of the invention is to make it possible to construct the pump with simple and inexpensive components.

This is achieved by constructing a hose pump as of type described above with at least one pressure roller and a hose track of a characterizing shape described below. As a result, in an embodiment having at least two pressure rollers, the roller rearwardly disposed in operation cooperates with the hose upon hose opening movement of the forwardly disposed roller, so that said rearwardly disposed roller, in addition to discharging a volume flow corresponding to the normal volume flow of the pump, also discharges an additional volume flow to compensate for the increase in volume caused by the hose expansion upon the opening movement of the forwardly disposed roller. Thus, the pump provides constant, metered volumes and, consequently, also compensates for reverse suction from the hose opening movement of the forwardly disposed pressure roller. This is a result of the shape of the hose track, which varies the travelling speed of the point of contact between the pressure rollers and the hose, so that the volume flow is kept constant in spite of the hose volume increase caused by the opening of the hose.

The variation in the travelling speed is achieved in that the hose track is so shaped as to bring about an increase and decrease, respectively, in the engagement angle between the axis of rotation of the pressure roller and a tangent for the hose defined by the point of contact. This causes the distance from said point of contact to the axis of rotation of the pump to be increased, and because of the constant rotary speed of the pressure roller, increasing and decreasing engagement angles, respectively, between the hose and the pressure roller cause an increase and a decrease, respectively, in the travelling speed of the point of contact.

When, according to the invention, the travelling speed of the point of contact is adjusted, a pump will be achieved in a simple manner which can discharge a constant volume flow even with very small angular rotations. Further, when constructing the pump on the basis of the requirements relating to constant rotary speed of the drive shaft and a varying hose track depth without using complicated structures, it is possible to construct the pump from simple components which, in addition to being inexpensive, can be given small dimensions. These features in combination make the pump of the invention highly useful as a medicine pump, e.g. for insulin, it being a sine qua non within this field of use that the metered amount per angular rotation is constant. When, at the same time, the problem of the known pumps relating to reverse suction, as mentioned in the foregoing, has been compensated, another problem of insulin pumps is solved, it being appreciated that reverse suction at the outlet path of the pump might cause coagulation of the blood at the outlet opening, which would of course involve a great danger to a given patient.

The hose pump of the invention is advantageously so constructed that the engagement angle in sections of the track having no constant track depth involves an increment to the travelling speed of the point of contact. This compensates for the volume increase occurring when the hose changes from being compressed at a hose track depth slightly smaller than the double hose wall thickness to only just being closed, which is a consequence of a wish for providing a certain overcompression along certain sections of the hose. In addition, there are sections with a constant track depth, and where varying engagement angles cause additional increments to the travelling speed of the point of contact. This will be necessary in the sections where the hose changes from being only just closed to being completely open, so that the speed increment mentioned here will occur as a result of the further opening movement of the hose.

Thus, this means that when cooperating with the hose and its associated track the pressure rollers will always be able to deliver constant metered volumes, even with relatively small angular rotations.

In a preferred embodiment, the hose pump of the invention is so constructed that the support face is shaped as a plane face, a rotary shaft parallel with said face being provided for the mounting of two pressure rollers, and a drive shaft being connected with the rotary shaft transversely to it and between the pressure rollers. In this embodiment, the hose track extends substantially in spiral around the axis of the drive shaft and so that the track extends in an angle range of about 360°.

The so-called radial configuration of this pump structure entails that the hose receiving track may be provided in a particularly simple manner.

However, the pump may also be provided in a so-called axial configuration, which is characterized in that the support face is shaped as an internal cylinder face. In this other embodiment, it is just necessary that at least one pressure roller is present, which is journalled on a rotary shaft extending in parallel with the support face and connected with a drive shaft parallel with said face. The shape of the hose track here exhibits a helical line whose engagement angle wit the pressure roller determines the travelling speed of a given point of contact. The pump cycle of this structure, depending upon whether one or two pressure rollers are selected, comprises an angle range of about 720° or about 360°, respectively, and the structure is moreover unique in providing for more rigid attachment of the rollers when loaded by the hose and the support face.

The construction of the preferred hose pump in radial configuration can expediently be provided so that the pressure rollers with mounting as well as drive means for these are built together to form a fixture member, which comprises a fork-shaped bracket to receive the support plate of the hose so that said plate will be positioned properly with respect to the pressure rollers when the support plate is mounted in the bracket. Finally, the support plate may be made contiguous with a reservoir, e.g. for insulin, to which also the hose inlet end is connected.

The invention will be explained below with reference to the drawing, in which

Figure 2:
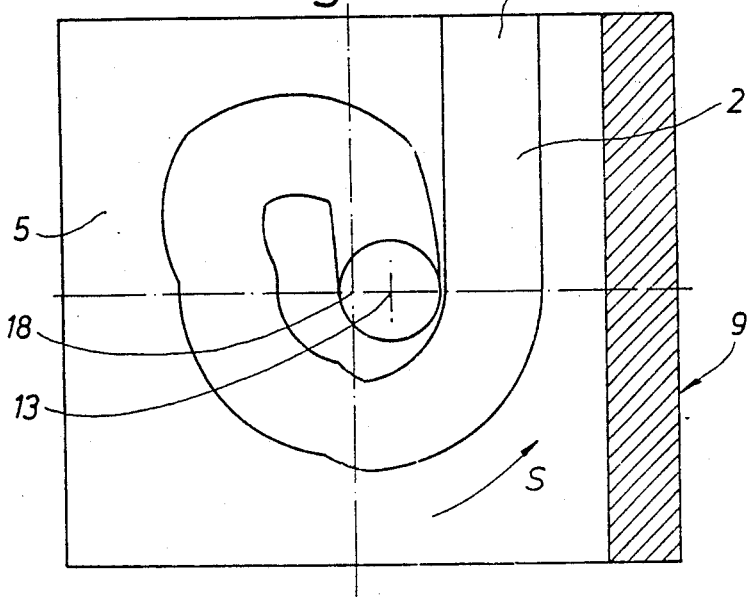
Figure 3:
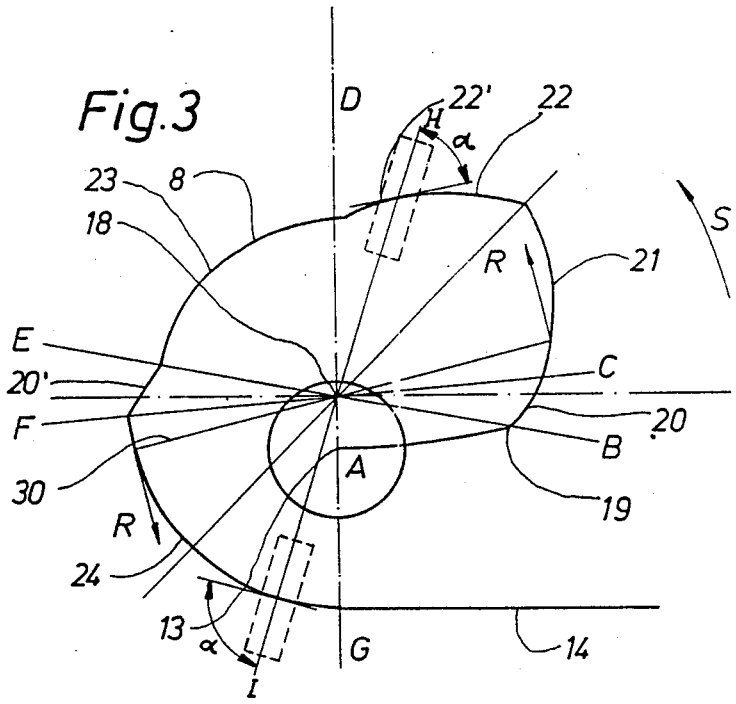
Figure 4:
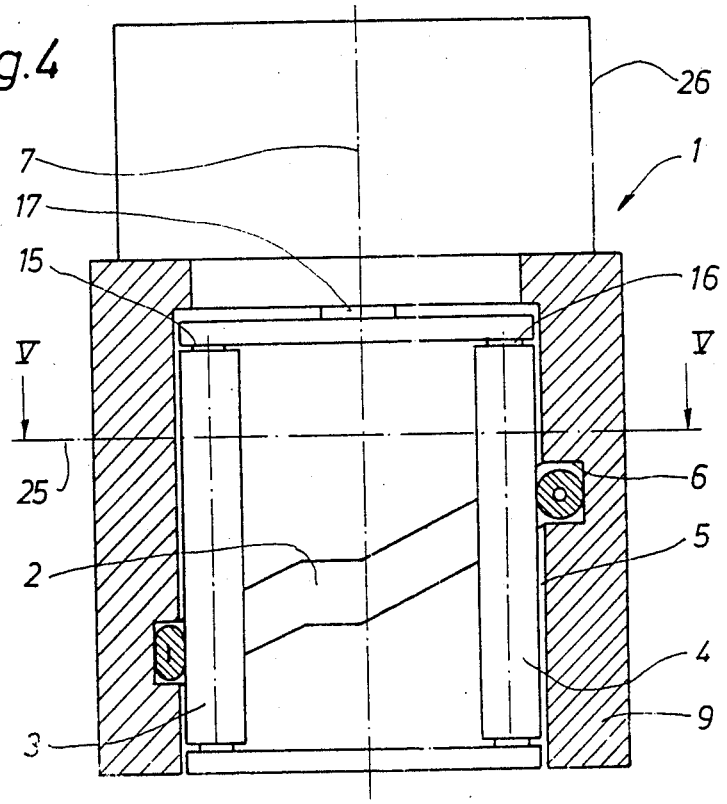
Figure 5:
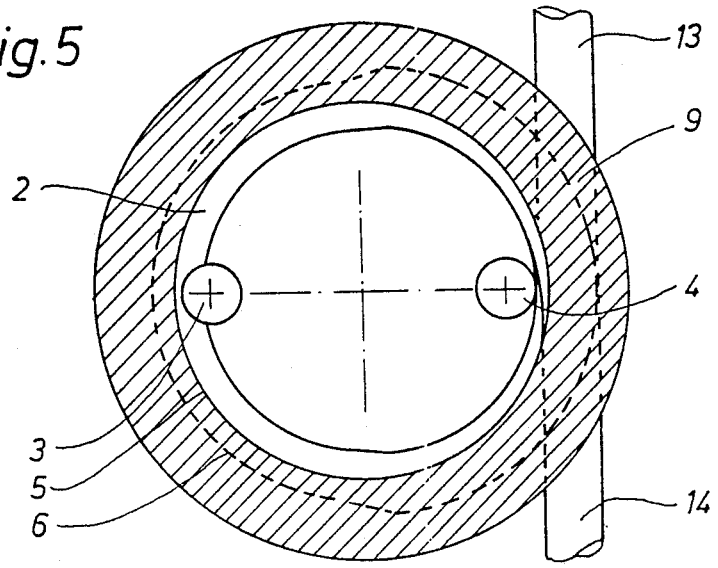

FIG. 1 shows the hose pump in radial configuration, seen in an axial section after the drive shaft, FIG. 2 is a section along the line II—II in FIG. 1, FIG. 3 shows schematically the hose track path, seen in the same manner as in FIG. 2, but on a larger scale and rotated clockwise through 90°, FIG. 4 is a second embodiment of the hose pump, shown here in axial configuration, seen in an axial section after the drive shaft, and FIG. 5 is a section along the lineV—V in FIG. 4.

The hose pump 1 shown in the drawing consists of a hose section 2, two rollers 3, 4, a drive source 26 and a support plate 9 on one tine of a fork- or U-shaped bracket 9*a*. The drive source 26 is preferably detachably connected with the support plate 9. The support plate 9 comprises a support face 5 with a hose receiving track 6 in which the hose 2 is placed and secured. The rollers 3, 4 cooperate with the support face 5 of the support plate 9 and affect the hose 2 in the flow direction S of the pump 1, and in specific angle ranges they alternately determine the liquid flow discharged by the pump. In the radial pump configuration shown in FIGS. 1 and 2, the rollers 3, 4 are rotatably journalled on a common rotary shaft 10 with the same distance to the centre 11 of the rotary shaft 10, and the support face 5 is shaped as a plane face. The drive source 26 comprises a drive shaft 12 with an axis of rotation 7. The drive shaft 12 is firmly connected with the centre 11 of the rotary shaft 10 in such a manner that the axis of rotation 7 is perpendicular to the support face 5.

In the axial pump configuration shown in FIGS. 4 and 5, the rollers 3,4 are rotatablyjournalled on their respective rotary shafts 15, 16, and the support face 5 is shaped as an internal cylinder face with an axis of symmetry which coincides with the axis of rotation 7 for the drive shaft 17 of the drive source 26. The drive shaft 17 is firmly connected withone end of the rotary shafts 15, 16 in such a manner that these extend in parallel with the axis of rotation 7.

The hose 2 comprises an inlet end 13 and an outlet end 14. The inlet end 13 is connected with a liquid container, e.g. an insulin container. Where the pump is used as an insulin pump, the outlet end 14 communicates with a catheter which is connected with the patient. The insulin container may advantageously be made of plastics and advantageously be secured, e.g. by welding, to the hose support plate, which may likewise advantageously be made of plastics, e.g. by injection moulding. Thus, the support plate, the hose and the insulin container will constitute a disposable member, which is discarded and replaced when the insulin container is empty. The disposable member may be detachably secured to the drive source member with the rollers, so that the pump will advantageously just consist of two detachable members.

The hose 2 may advantageously be made of plastics, e.g. softened PVC, and may e.g. have an outside diameter of slightly less than 1 mm when the pump is used as an insulin pump. Further, the pump 2 may advantageously be secured in the bottom of the hose receiving track 6 by means of gluing or welding.

The constant volume flow discharged by the pump 1 may be changed by changing the number of revolutions of the drive source 26. When the pump 1 is used as an insulin pump, the number of revolutions during metering may e.g. ½-1 revolution per second.

The embodiments of the pump 1 as shown in the drawing, when the pump is ued as an insulin pump, are preferably shown on a scale about 10:1, the pump dimensioning radius being expediently about 3.5 mm.

FIG. 3 shows the operation of the pump in the preferred embodiment of the path 8 of the hose receiving track 6. Further, the figure shows at the plotted axes (indicated at the points H and I) the engagement angle between the axes of rotation of the pressure rollers (indicated in broken lines) and the hose tangents defined by the points of contact; these varying angles between the hose and the pressure roller cause the travelling speed of the point of contact to increase or decrease. The path of the hose receiving track will be described below.

The path 8 extends in the center of the hose receiving track 6. When the depth of the track 6 is changed, the compression of thehose 2 caused by the rollers 3, 4 may vary along the path 8 of the track 6. The point where the axis of rotation 7 intersects the support face 5 is indicated by the reference point 18. The flow direction of the pump is indicated by the arrow S, which also corresponds to the direction of roller propulsion.

The location of the center axis 30 of the rotary shaft 10 of the rollers is plotted at an arbitrary moment during the rotation of the rotary shaft 10 about the axis 11. Here, the momentary rolling direction of the rollers is indicated by the arrows R. The location of the centre axis 30 is also plotted at other arbitrary moments, e.g. when the front roller is at the point E and the rear roller at the point B, the front roller at the point F and the rear roller at the point C, etc. In the shown embodiments where the pump 1 comprises two rollers, the path 8 of the hose receiving track 6 traverses an angle range A–G of about 360° , from the inlet end 13 of thepump to the outlet end 14 of the pump. At the pump inlet end 13 where the hose has been introduced e.g. from behind perpendicularly to the support face, the hose is fully open, i.e. the depth of the hose receiving track is slightly greater than the outside diameter of the hose. The track depth diminishes gradually in the following angle range A–B, so that at the point 19 it corresponds to the thickness where the hose only just closes, which means that the hose will only just be closed under the influence of the roller in question. When the fowardly disposed roller is at the point E, the succeeding roller is at the point B. The depth of the hose receiving track 6 at the point E is slightly smaller than the double hose wall thickness, which causes the hose to be compressed extra hard by the forwardly disposed roller so as to provide for desired overcompression of the hose. When the succeeding roller then rotates through the angle rang B–C forwardly to the point C, the forwardly disposed roller rotates through the angle range E–F forwardly to the point F. The depth of the hose track 6 decreases in the angle range B–C so that at the point C it is slightly smaller than the double hose wall thicknessso that overcompression of the hose is established at the point C. The depth of the hose track increases in the angle range E–F and is at the point F equal to the double hose wall thickness, so that the hose is only just closed at the point F. The path 8 of the hose track may be formed by circular arc segments 20 and 20', respectively, in the angle ranges B–C and E–F, with an evenly increasing radius to the reference point 18. The important feature is that the circular arc segments 20 and 20' are the same, and that they have the same initial radius (at the point B and the point E, respectively) and the same final radius (at the point C and the point F respectively). What is important is that the succeeding roller assumes the overcompressing state simultaneously with the front roller cancelling its overcompressing state, it being obtained by rotation through the angle ranges C–B and E–F, respectively, that the front roller is simultaneously given such an increasing relative speed with respect to the hose that volume flo ahead of this roller is compensated, and that the rear roller is simultaneously given such an increasing relative speed with respect to the hose that loss of volume flow behind the front roller is compensated.

Then the succeeding roller rotates through the angle range C–D, and the front roller rotates through the angle range F–G. The depth of thehose receiving track increases evenly in the angle range F–G forwardly to the point G, where the depth corresponds to the outside diameter of the hose so that it is fully open here. The depth of the hose receiving track in the angle range C–D is constant so that the desired overcompression of the hose is ensured in this angle range. In the angle range F–F, the path 8 of the hose receiving track may be formed by a circular arc segment with a constant radius. In the angle range C–D, the path 8 of the hose receiving track may advantageously be formed by two or more successive segments 21, 22, 22' of Archimedean spirals having an evenly increasing radius and an evenly decreasing radius, respectively. In this angle range, compensating volume flow increases are provided by changing the path 8 of the hose receiving track in a direction away from being parallel with the momentary rolling direction R of the rollers. This has the effect that the succeeding roller cooperates with the hose during the opening movement of the forwardly disposed roller from having closed the hose completely to letting it be completely open, so that, in addition to discharging a volume flow corresponding to the normal volume flow of the pump, the pump also discharges an additional volume flow to compensate the loss caused by the opening movement of the forwardly disposed roller. This ensures that the volume discharged by the pump is constant per drive shaft angular rotation. The important feature is that a specific proportion is established between the relative speed of the succeeding roller with respect to the path 8 of the hose receiving track and the relative speed of the forwardly disposed roller with respect to the path 8 of the hose track, when the forwardly disposed roller, from having closed the hose, rotates through the angle range F–G to open the hose completely, so that the succeeding roller provides the desired additional volume flow to compensate the loss caused by the opening movement of the forwardly disposed roller.

Then the succeeding roller rotates through the angle range D–E, and the forwardly disposed roller rotates through the angle range G–B, whereby the pump drive shaft will have rotated half a revolution, which corresponds to one pump cycle. In the angle range D–E, the depth of the hose receiving track is slightly smaller than the double hose wall thickness, so that, in this angle range D–E, the path 8 of the hose track may be formed by a circular arc segment with a constant radius to the reference point 18, and this radius has a dimensioning infuence on the amount discharged by the pump at a specific number of revolutions, the outlet end 14 of the pump being completely open when the succeeding roller rotates through the angle range D–E. Then the succeeding roller changes to being the forwardly disposed roller and vice versa, and a new pump cycle takes place.

The present invention has been described with reference to two preferred embodiments. However, many modifications may be made without departing from the spirit of the invention, so that the hose pump may e.g. be used for many other types of pumps than precisely insulin pumps.

I claim:

1. In a hose pump of the type comprising an elastic hose for local compression between a hose supporting face and at least one pressure roller for rotation at a constant speed of rotation around an axis, of the pressure roller whereby to pumpingly flow liquid in the hose to an outlet end of the hose, the supporting face being formed with a track for receiving the hose, the track having a varying depth for determining the degree of the local hose compression, the improvement in that the track comprises at least one section with an increasing engagement angle and at least one section with a decreasing engagement angle, the engagement angle being the angle between the axis and the track and, thereby, the hose therein at the point of the local compression between the pressure roller and the hose, the sections of the track being so positioned and their engagement angles so increased and decreased as to comprise compensation means for increasing the flow of the liquid in the hose by an amount compensating for decreased flow caused by opening of the outlet end of the hose.

2. A hose pump according to claim 1, wherein a section with a decreasing track depth is followed by a section with a constant track depth and with an engagement angle causing an additional increment to the travelling speed of the point of contact.

3. A hose pump according to claim, wherein, in a first path section (B–C), the hose track (6), as seen in the flow direction (S) from the point (19) where the hose (2) is just closed, constitutes a circular arc segment (20) with an evenly increasing radius measured from the axis (18) of the drive shaft and with an evenly decreasing track depth, and that, in a second path section (E–F) which is traversed by the front roller (3) as the rear roller (4) traverses the first path section (B–C), the hose track (6) has the same shape as in the first path section (B–C), but with a constantly increasing track depth, and that, in a third path section (C–E) disposed between the said first and the said second path sections, the hose track (6), as seen in the flow direction (S), is shaped as at least two successive (21, 22 and 22') segments of Archimedean spirals with an evenly increasing radius and an evenly decreasing radius, respectively, followed by a third circular arc segment with a constant radius, and that, in a fourth path section (F–G) disposed after a path section (E–F), the hose track (6), as seen in the flow direction (S), is shaped as a fourth circular arc segment (24) with a constant radius and with a continuously increasing track depth, the arc angle of said fourth path section (F–G) corresponding to the arc angle of the path section (C–D) within which the track (6) has two or more successive spiral-shaped courses (21, 22 and 22').

4. A hose pump according to claim 1, wherein the support face is shaped as an internal cylinder face, and comprising at least one pressure roller journalled on a rotary shaft extending parallel with the support face and connected with a drive shaft parallel with said face, characterized in that the hose track extends as a helical line with varying angles of pitch.

5. A hose pump according to claim 4, wherein, in a first path section, the hose track (6), as seen in the flow direction from the point where the hose (2) is just closed, is shaped as a line segment with an evenly increasing distance to a reference plane (25) and with a continuously decreasing track depth, and that, in a second path section traversed by the front roller (3) as the rear roller (4) traverses the first path section, the hose track (6) has the same shape as in the first path section, but with a continuously increasing track depth, that, in a third path section disposed between the first and the second path sections, said track (6), as seen in the flow direction, is shaped as at least two successive line segments whose distance from the reference plane (25), proportional to the pressure roller movement, increases and decreases, respectively, said two line segments being followed by a third line segment with a constant distance to the reference plane (25), and that, as seen in the flow direction, said track (6) has a fourth path section which is shaped as a fourth line segment with a constant distance to the reference plane (25) and with a continuously increasing track depth, the arc angle of said fourth path section corresponding to the arc angle of the path section within which the hose track (6) has two or more successive line segment courses whose distance from the reference plane (25), proportional to the pressure roller movement, increases and decreases, respectively.

6. A hose pump of the type comprising an elastic hose which may be compressed locally on its length between an inlet (13) and an outlet (14) section thereof between a hose supporting face (5) and at least one pressure roller orbiting around an axis whilst rotating around its own axis, said support face (5) being formed with a track (6) adapted to receive the hose and whose varying depth determines the degree of hose compression, said track being so arranged that at least two portions of the hose are affected simultaneously by the same or respective rollers, characterized in that said track comprises at least one section with an increasing engagement angle and at least one section with a decreasing engagement angle, said engagement angle being defined by the angle ($\alpha$) between the axis (H–I) of rotation of the pressure roller and the tangent to the hose at the point of contact between the pressure roller and the hose, said sections being so positioned that the increased flow caused by the varying engagement angles compensates the decreased flow caused by the opening of the hose at the outlet section of the hose.

7. A hose pump according to claim 6, characterized in that a section (B–C) with a decreasing track depth is followed by a section (C–D) with a constant track depth and with an engagement angle causing an increment to the travelling speed of the point of contact.

8. A hose pump according to claim 6 having an inlet section (B–C) with a track decreasing from a value corresponding to just closed hose to a value corresponding to overcompression of the hose, and an intermediate section (E–F) with a track depth increasing from said letter to said former value, said two sections being traversed simultaneously and synchronously by a roller and having at point of roller engagement the same radius which varies between wo different values so that the increased flow caused by said variation compensates the loss of flow caused by the roler passage of said two sections.

9. A hose pump according to claim 6, wherein the support face is a plane face which is parallel to a rotary shaft shared by a pair of rollers between which said rotary shaft is connected to a drive shaft defining said orbit axis and extending perpendicularly to said support face characterized in that the distance between the orbit axis and the hose track is varying along the length of the latter.

10. A hose pump according to claim 6, wherein the support face is shaped as an internal cylinder face, and wherein the axis of said at least one pressure roller as well as its orbit axis extend parallel with said cylinder, characterized in that the hose track extends as a helical line with varying angles of pitch.

11. A hose pump according to claim 9, characterized in that, in a first path section (B–C), the hose track as seen in a flow direction (5) from a first point (19) where the hose is just closed, constitutes a circular arc segment with an evenly increasing distance from the orbt axis of the drive shaft and with an evenly decreasing track depth, and that, in a fourth path section (E–F) which is traversed by one roller (3) as the other roller (4) traverses the first path section (B–C), the hose track (6) has the same shape as in said first path section (B–C), but with an evenly increasing track depth, and that, in a second path section (C–E) disposed after said first path section, the hose track, as seen in the flow direction (S), is shaped as at least two successive segments of Archimedean spirals with an evenly increasing radius and an evenly decreasing distance from said orbit axis respectively, followed by a third arc segment (D–E) having its centre positioned on the orbit axis, and that, in a fifth path section (F–G) disposed after said fourth path section (E–F), the hose track as seen in the flow direction (S) is shaped as a circular segment with its centre positioned on the orbit axis and with a continuously increasing track depth, the arc angle of said fifth section (F–G) corresponding to the arc angle of said second path section (C–D).

12. A hose pump according to claim 9, characterized in that, in a first path section, the hose track, as seen in a flow direction from a first point were the hose (2) is just closed, is shaped as a line segment with an evenly increasing distance to a reference plane and with a continuously decreasing track depth, and that, in a fourth path section traversed by one roller as the other roller traverses said first path section, the hose track has the same shape and position with respect to the orbit axis and the reference plane as that of the first path section, but with a continuously increasing track depth, that, in a second path section disposed after said first path section, said track, as seen in the flow direction, is shaped as at least two successive line segment whose distances from the reference plane increases and decreases, respectively, said two line segments being followed by a third path section with a constant distance to the reference plane, and that, as seen in the flow direction, said track has a fifth section which is shaped as a line segment with a constant distance to the reference plane and with a continuously increasing track depth, the arc angle of said fifth path section corresponding to the arc angle of said second path section.

13. A hose pump according to claim 6, characterized in that the pressure rollers as well as bearings and drive means for these are attached to a fixture member comprising a forkshaped bracket to receive a support plate for the hose, so that said hose will be positioned properly with respect to the roller when the support plate is placed in the bracket.

14. A hose pump according to claim 13, characterized in that the support plate is contiguous with a reservoir, and that the inlet end of the hose is connected to said reservoir.

* * * * *